US008002082B2

(12) United States Patent
Snedeker

(10) Patent No.: US 8,002,082 B2
(45) Date of Patent: Aug. 23, 2011

(54) DRAG RESCUE DEVICE

(75) Inventor: Julie Snedeker, Northwood, NH (US)

(73) Assignee: Globe Holding Company LLC, Pittsfield, NH (US)

( * ) Notice: Subject to any disclaimer, the term of this patent is extended or adjusted under 35 U.S.C. 154(b) by 816 days.

(21) Appl. No.: 11/946,830

(22) Filed: Nov. 28, 2007

(65) Prior Publication Data

US 2008/0164095 A1 Jul. 10, 2008

Related U.S. Application Data

(60) Provisional application No. 60/867,684, filed on Nov. 29, 2006.

(51) Int. Cl.
*A62B 35/00* (2006.01)
*A41D 13/00* (2006.01)

(52) U.S. Cl. ..... 182/3; 2/69; 2/94

(58) Field of Classification Search ..... 182/3; 2/69, 2/94

See application file for complete search history.

(56) References Cited

U.S. PATENT DOCUMENTS

| | | | | |
|---|---|---|---|---|
| 2,758,769 | A * | 8/1956 | Nunn et al. | 119/770 |
| 2,979,153 | A * | 4/1961 | Hoagland et al. | 182/3 |
| 5,442,821 | A * | 8/1995 | Weeks | 5/89.1 |
| 5,562,513 | A * | 10/1996 | Kaiser | 441/111 |
| 6,205,584 | B1 * | 3/2001 | Yocco | 2/69 |
| 6,397,784 | B1 * | 6/2002 | Morgan-Albertson et al. | 119/792 |
| 2007/0044197 | A1 * | 3/2007 | Turcotte et al. | 2/69 |

* cited by examiner

*Primary Examiner* — Alvin C Chin-Shue
(74) *Attorney, Agent, or Firm* — Finch & Maloney PLLC

(57) ABSTRACT

A drag rescue device for rescuing incapacitated firefighters, emergency workers and others provides for easier and more dependable deployment as well as improved serviceability and ease of use. A method of reinforcing openings in garments is provided that can result in improved reinforced openings in garments where stress and strain may otherwise result in undue wear on the opening.

8 Claims, 9 Drawing Sheets

DRAG RESCUE DEVICE

RELATED APPLICATION

This application claims benefit of U.S. Provisional Patent Application Ser. No. 60/867,684 titled "DRAG RESCUE DEVICE," filed Nov. 29, 2006 and which is hereby incorporated by reference herein.

BACKGROUND

1. Field of Invention

The invention relates to a drag rescue system and, in particular, to a drag rescue device for use by emergency responders.

2. Discussion of Related Art

High risk personnel such as firefighters, defense workers and emergency responders may be exposed to hazardous conditions that can render the worker unconscious or otherwise incapacitated. In these situations it is often high priority to remove the worker from the situation before further injury occurs. In many cases this process is performed by other personnel on site. To facilitate safe removal of an injured or incapacitated person, the worker's clothing may include a drag rescue device that is accessible to another party. The drag rescue device may be a strap that secures the worker under the arms and allows an able party to grab the strap and extract the injured worker from the hazardous condition. The strap may be contained in a coat such as is described in U.S. Pat. No. 6,205,584 to Yocco titled "Coat Incorporating a Drag Hamess." As described in Yocco, the strap may extend outside of the worker's coat through an opening in the back. This can shorten the amount of time that it may take a rescuer to find and secure the drag rescue device.

SUMMARY OF INVENTION

In one aspect of the invention, a drag rescue device for use with a coat is provided, the drag rescue device comprising a loop of ribbon-shaped material including a left portion and a right portion, the portions joined to each other at a drag end of the loop, the drag end configured and arranged to pass through an opening in the coat, and a guide attached to a portion of the loop that is distal to the drag end, each of the left portion and right portion slidably retained by the guide.

In another aspect, a coat for use with a drag rescue device is provided, the coat comprising a torso portion including a back and two side panels, the back defining a slit for passage of the drag rescue device through the coat, two sleeves attached to the torso portion, a collar attached to the top of the torso portion, and a flap mounted on the collar, the flap constructed and arranged to cover the slit in the back when the flap is in a closed position.

In another aspect, a drag rescue system is provided, the system comprising a drag rescue device comprising a loop including shoulder portions and a handle portion wherein the handle portion comprises two overlapped opposed ends of a strap permanently joined together to form the fixed loop, and a coat comprising a shell having an inside and an outside, the shell including a back portion that defines a slit for passage of the drag rescue device wherein the shoulder portions of the loop are inside the shell and the handle portion of the loop is positioned outside the shell.

In another aspect, a method of reinforcing a slit in a piece of fabric is provided, the method comprising providing first and second sheets of reinforcing material, each of the sheets having a first end, a second end and two side edges, an ear on each end and a foldable tab along one edge, the tab positioned between the ears, passing each tab through the slit to be reinforced, the first sheet positioned on one side of the slit and the second sheet positioned on the opposing side of the slit, folding each tab back underneath the fabric to form a sandwich of reinforcing material/fabric/reinforcing material on each side of the slit, overlapping each ear of the first piece with a corresponding ear of the second piece to form a pair of overlapped ears, stitching together each pair of overlapped ears, and stitching through the sandwich to secure the reinforcing material to the fabric.

The subject matter of this application may involve, in some cases, interrelated products, alternative solutions to a particular problem, and/or a plurality of different uses of a single system or article.

DETAILED DESCRIPTION

Figure 1:
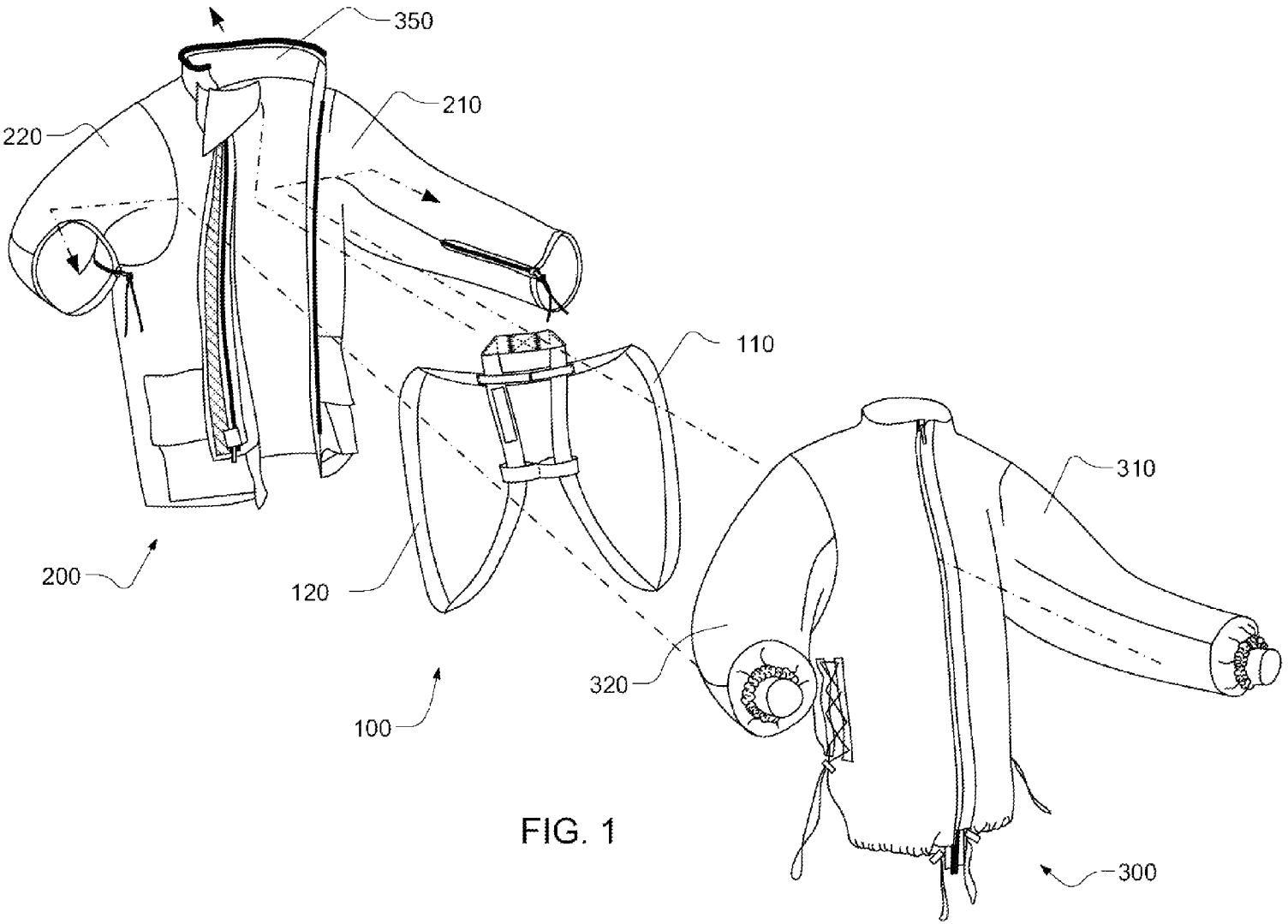
FIG. 1 is an exploded view of one embodiment showing a liner, a drag rescue device and an outer shell.

As used herein, "wearer" and "user" may be used interchangeably to denote a person wearing a drag rescue device.

Drag rescue devices may be required equipment for firefighters, emergency response team members and others who may be subject to hazardous working conditions. For example, NFPA 1971 Standard on Protective Ensembles for Structural Fire Fighting and Proximity Fire Fighting mandates that all firefighter garments be equipped with an integral drag rescue device. Therefore, not only should these devices perform their safety function successfully but their everyday use means that the devices should preferably be comfortable, unobtrusive and easy to care for.

A firefighter's coat often includes both an inner liner and an outer shell. The outer shell may provide for protection against water and flame while the inner liner may protect against, for example, heat and hazardous substances. An integral drag rescue device may be incorporated into a coat and in some embodiments may be positioned between the shell and the inner layer. The drag rescue device may wrap around the firefighter's arms and extend outwardly through an opening in the back of the coat. If a portion of the drag rescue device is accessible from outside the garment, it may provide for faster locating of the device under adverse conditions. When a force is applied by a rescuer, the device may tighten around the wearer's arms so that the wearer can be dragged, typically in a supine position, out of harm's way.

The drag rescue device may be made of any appropriate material, such as, for example, polyester, nylon, KEVLAR, NOMEX, polypropylene or natural fibers. The drag rescue device may be made from a single loop of material. The loop may be permanently fixed or may include attachable ends that can be joined together to form the loop. A portion of the loop may include a handle that can be grasped by the rescuer. The loop may include a left portion and a right portion with the left portion passing underneath the user's left arm and the right portion passing under the user's right arm. The left and right portions may be joined to each other, for example, by the handle portion and by a straight horizontal portion that runs across the back. When not under strain, the drag rescue device can fit loosely around the user's shoulders/arms and, in some cases, the user may not even feel that it is there.

In a preferred embodiment the material may be a ribbon-shaped material such as a strap or belt. This may help, for example, to provide for a comfortable fit. Alternatively, the material may be rounder in cross section and may be similar or identical to rope or other braided material. This design may be, for example, less susceptible to twisting. Embodiments described herein will be discussed with reference to ribbon-shaped material although other shapes may be equally applicable.

In many instances, the material should meet the requirements of a specific regulation, such as NFPA 1971. Although the loop may be of consistent size throughout, the width and/or thickness and/or diameter may vary at different sections of the device. The width of the material may be, for example, greater than or equal to 1 cm, 2 cm, 3 cm, 4 cm, 5 cm or more. Thickness may typically be about 1 mm, 2 mm, 3 mm, 4 mm or more. Width and thickness may be chosen, for instance, based on level of comfort and required strength. The length of the loop is typically based, at least partially, on the size of the user. Thus a drag rescue device may be custom-sized based on the size of the coat that it is to be integrated with. For instance, a size 48 coat may be shipped with a drag rescue device that is six inches longer than one that is shipped with a size 42 coat.

In a preferred embodiment the drag rescue device may be worn between an outer shell and an inner layer of a garment. It has been determined that because drag rescue devices may fit loosely around the user's arms when not in use, past versions of similar devices could fall down the arm toward the elbow resulting in an uncomfortable and potentially unsafe configuration. The drag rescue device described herein may include a guide that may help retain the strap around the shoulder and upper arm area. The guide may be attached to a central portion of the drag rescue device and can help to retain the left and right portions of the strap in a central location, helping to resist slipping down the arm.

In another embodiment, the device may include a guide that aids in installation of the device. When a garment is being serviced the liner and drag rescue device are typically removed from the shell. This may allow the individual components to be cleaned and/or inspected and/or repaired separately. It also means that the components need to be put back together and that the re-assembly should be done properly to insure that the drag rescue device will function as designed. In the past, many users would find it difficult to thread the strap in the correct manner and could not be sure that the components had been re-assembled correctly. In one embodiment described herein, the device may be in the form of a permanently fixed loop and a portion of the strap may include a guide that the handle portion of the strap is threaded through. A "permanently fixed" loop is one in which the loop is designed not to be easily broken or separated by the user. The handle portion can be threaded through the guide and across the back portion of the device to aid with proper installation. In a further embodiment the strap may be passed through the guide during manufacture and may be permanently, though slidably, retained by the guide. In this manner, the proper configuration of the drag rescue device may be maintained while allowing the device to be serviced and/or inspected.

If permanently retained by the guide, the device is designed to not be removable from the guide by the user. Of course, the same function can be obtained by instructing a user to not remove a "removable" connection, but this method is typically not preferred as it is subject to error should the user decide to remove the connection anyway.

FIG. 1 provides an exploded view of a system including a firefighter's coat and a drag rescue device 100. The coat includes outer shell 200 and inner liner 300. When assembled, liner 300 fits inside of shell 200 with drag rescue device 100 positioned between the liner and the shell. Left portion 110 fits over sleeve 310 and right portion 120 fits over sleeve 320. Left portion 110 may be inside of shell sleeve 210 and right portion 120 may be inside of right sleeve 220. When the garment is assembled with all three components in place, all three may be donned and removed simultaneously by simply slipping on or off the coat. Drag rescue device 100 may not even be visible to the wearer of the garment.

Figure 2:
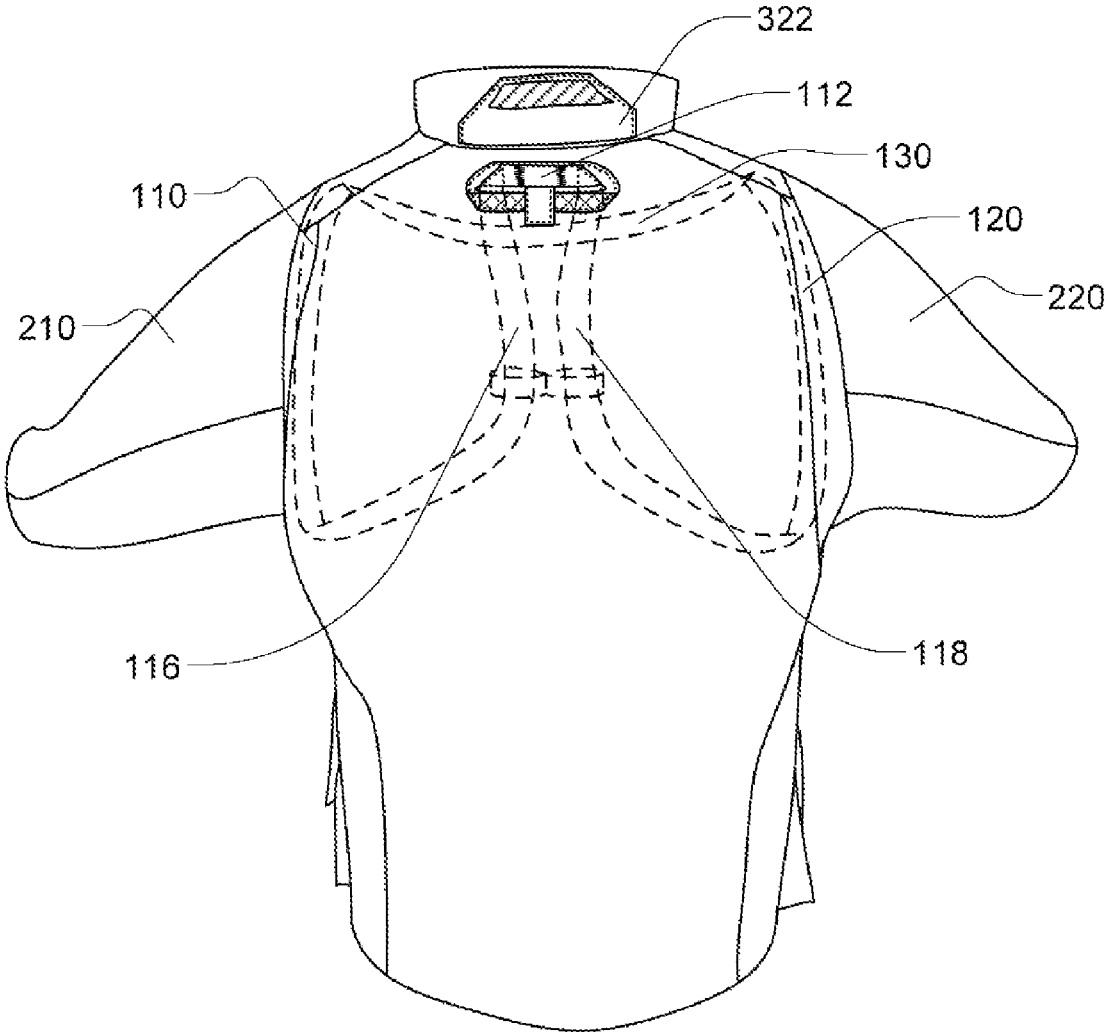
FIG. 2 is a view of one embodiment showing the back of a garment with a drag rescue device installed therein.

FIG. 2 provides a rear view of a firefighter garment with a drag rescue device installed. The device is shown in a relaxed position, as typically worn when a rescue is not called for. From this view, leads 116 and 118 may be positioned behind cross portion 130. This may help in securing the device around the shoulder area, rather than slipping down the arms, when a rescuer grabs the device and pulls upwardly or outwardly. In some embodiments, the only part of the drag rescue device that may be visible when the device is undeployed is handle portion 112. In addition, tab 322 may be used to cover handle 112 so that none of the drag rescue device is directly visible. Tab 322 may be easily recognizable, may stand out from the coat, and may be easily accessed when a rescuer needs to locate the device on an incapacitated wearer.

Figure 3:
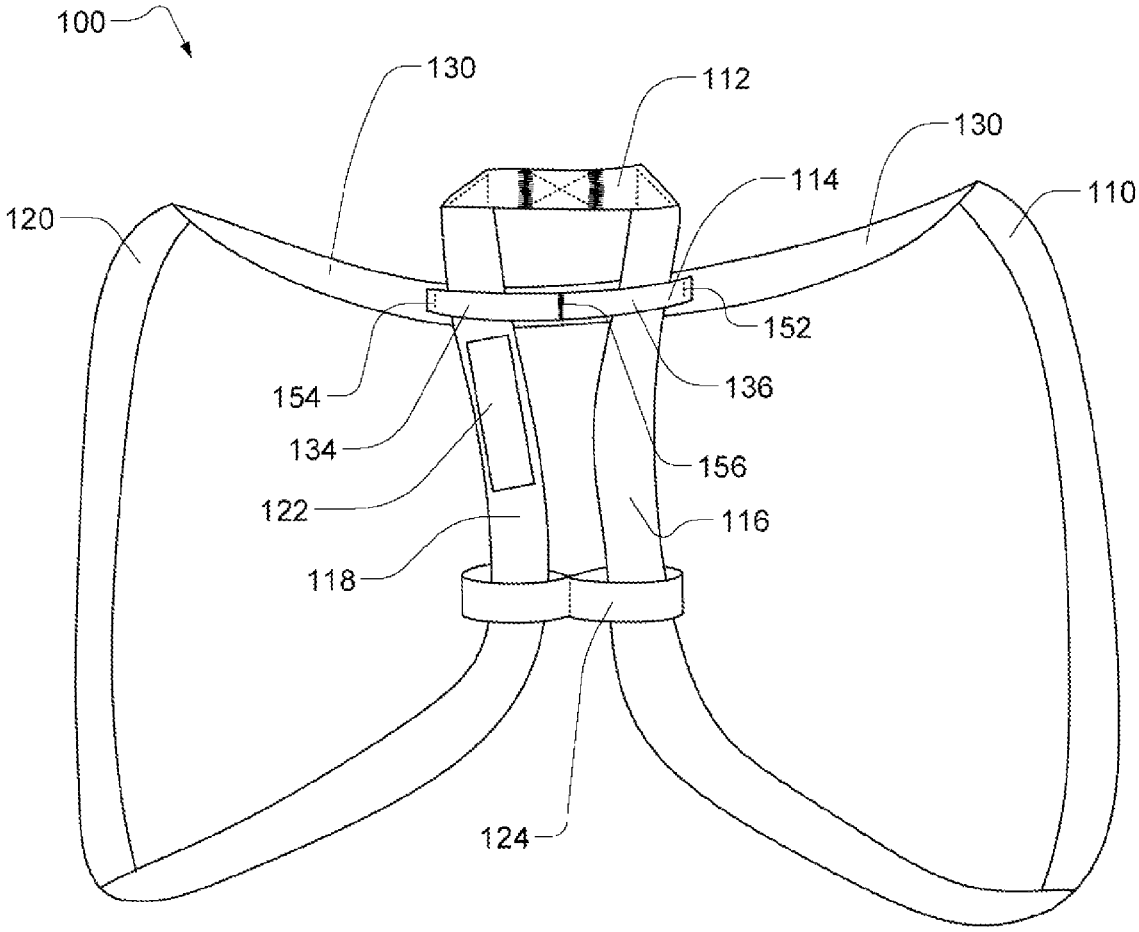
FIG. 3 provides a plan view of one embodiment of a drag rescue device.

One embodiment of the drag rescue device is illustrated in FIG. 3. Although the device may be a single loop of material, it may be helpful to divide it into portions for discussion of its operation. Left and right sub-loops 110 and 120 may fit loosely around the user's arms until the device is needed, at which point a rescuer may grab handle 112 to drag the user to safety. As handle portion 112 is pulled (typically through a slit in the back of the coat) by the rescuer, leads 116 and 118 may slide through guides 114 and 124 resulting in a tightening of portions 110 and 120 around the shoulders of the wearer. By running leads 116 and 118 across the top of cross portion 130, the dragging force supplied by the rescuer is applied across the shoulders with the force distributed around the upper arms and under the arm pits. If leads 116 and 118 were to run underneath cross portion 130, the majority of the force would be supplied at a position lower on the wearer's back and arms, possibly resulting in pulling the device down, or even totally off of, the wearer's arms. This possible mis-threading of the leads 116 and 118 might also result in pulling the arms of the user behind the user's back in a potentially uncomfortable and dangerous position. Label 122 may include information such as, for example, size, care instructions, manufacture date, contact information and installation instructions.

Guide 114 can help to assure that handle 112 is threaded properly across the top of cross portion 130. When a system including a shell, a liner and a drag rescue device is assembled, the first step is typically to lay down the shell with the front open and facing up. The drag rescue device may then be placed in position in the shell. The liner can then be inserted with the left arm of the liner passing through the sub-loop formed by left portion 110 of the drag rescue device and the right arm of the liner passing through the sub-loop formed by the right portion of the drag rescue device. It is evident that absent guide 114 one could easily place leads 116 and 118, as well as handle 112, behind cross portion 130 resulting in an incorrect configuration of the system. Furthermore, the incorrect assembly may not be evident until the device is put to use in an emergency situation. Thus, handle 112 may be slidably threaded through guide 114 which may be formed, for example, by attaching a strap to cross piece 130 at tack points 152 and 154. The guide may be easily distinguishable from cross portion 130 to which it is attached and therefore clear directions can be provided to the user to have the guide strap facing upward and to thread the handle through the guide strap to assure proper configuration.

In another embodiment, guide strap 114 may also be tacked to cross portion 130 at point 156 resulting in sub-guides 134 and 136. This tacking may be removable but in many embodiments is permanent. The guide strap may be tacked to cross portion 130 using methods known to those skilled in the art, such as stitching, weaving, welding and/or adhering. As is evident from FIG. 2, the addition of tack point 156 means that handle 112 cannot be withdrawn completely backward through guide 114 but will be retained at tack point 156. Therefore, to achieve this configuration, handle 112 may be passed through guide 114 prior to tacking guide strap 114 to cross portion 130 at point 156. This may be most efficiently accomplished during the manufacturing process. This may mean that, once deployed in the field, the drag rescue device may be removable from the garment for servicing but may not be completely disassembled to form an unobstructed loop. However, leads 116 and 118 may remain slidable through sub-guides 136 and 134 even if they cannot be completely removed. Furthermore, the drag rescue device may remain completely flexible and may be easily cleaned, inspected or serviced.

Figure 5:
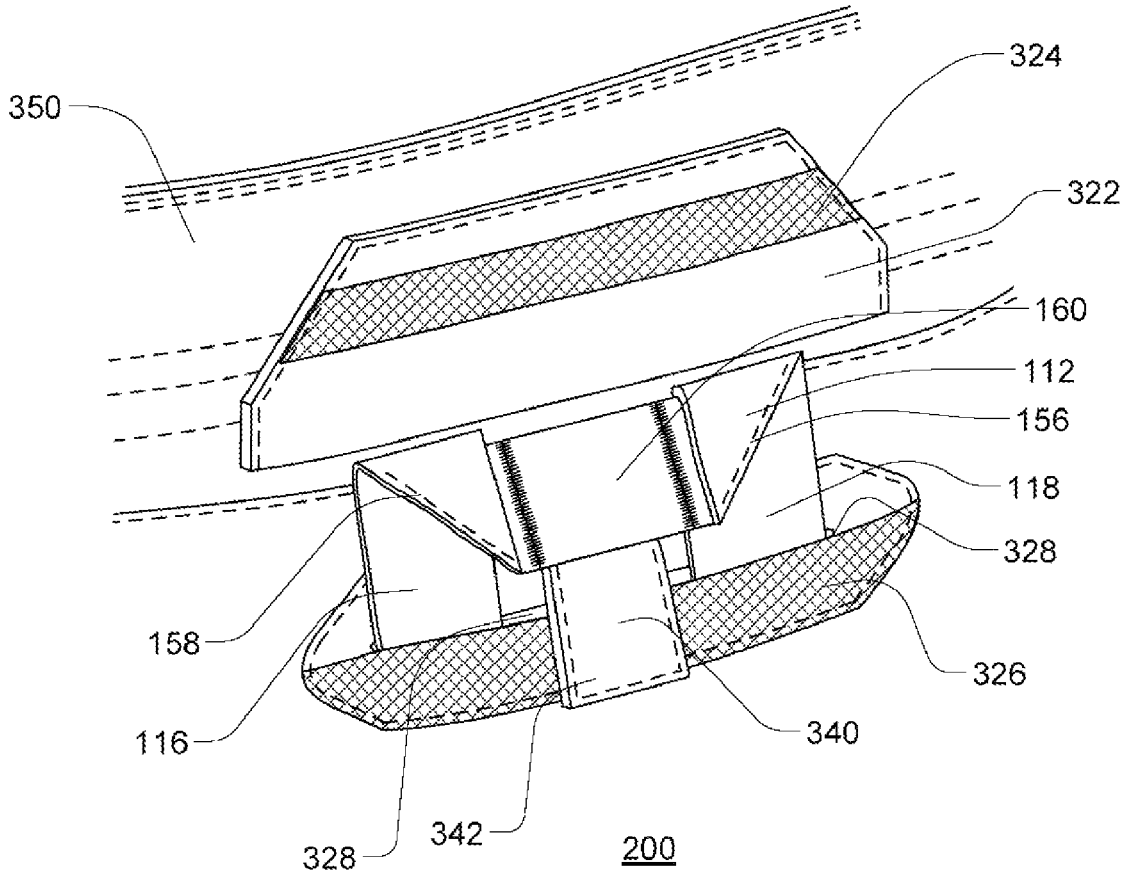
FIG. 5 is a view of one embodiment of the device in which the device handle passes through a slit in the outer layer of a firefighter's coat.

FIG. 5 provides a close-up view of one embodiment of the back of a firefighter's coat including reinforced slit 328 through which the drag rescue device is accessible. As shown, the drag rescue device is undeployed with handle portion 112 and parts of left portion 116 and right portion 118 passing externally of outer shell 200. Tab 340 may prevent handle portion 112 from slipping back through slit 328. Tab 340 may include removable end 342 that may be removably attached to closure 326. As shown, closure 326 may be one half of a hook and loop fastener and the complementary half may be on the underside of removable end 342 (and thus cannot be seen in FIG. 5). For instance, closure 326 may be a "loop" side of a hook and loop fastener while the "hook" side may be on the underside of tab 340. The opposing end of tab 340 (hidden under handle 112) may be permanently fixed to shell 200, such as with stitching. When the drag rescue device is to be installed or removed, removable end 342 may be lifted from closure 326 to allow handle 112 (or any portion of the drag rescue device) to be passed inward or outward through the full width of slit 328.

Flap 322 may be used to cover slit 328 and handle 112 of the drag rescue device. Flap 322 may fold downward and may help to repel water and debris from entering slit 328. Flap 322 may be wider than is slit 328 and may completely cover the slit and any reinforcing around the slit that might otherwise be visible. The outer surface of flap 322 may include an indication, such as printed text, that a drag rescue device is accessible therein. Flap 322 may include one side of a fastener, for example, hooks 324. A complementary fastener side may be attached to the outer surface of shell 200. Fastener 326 may serve to attach both tab 340 and flap 322, or each may have an individual fastener with which it is associated. Flap 322 may be mounted to collar 350 or to the back of the torso portion of the coat. If mounted to collar 350, flap 322 may be fixed above the torso portion of the coat allowing for positioning of slit 328 high on the back of shell 200.

In some situations, it may be advantageous to mount the access slit 328 as high as possible on the back of the shell. When used in an emergency rescue, a drag rescue device may be designed to drag an incapacitated person head first, in a supine position. The drag rescue device may be arranged to apply the pulling force as high as is practical on the person's body. This arrangement may, for example, help to keep the person's head off of the floor, ground, stairs, etc., and to minimize the chances of further injury. To assure that the incapacitated person is moved in this manner, it may be helpful to mount the drag rescue device in the coat at a position that is as high as possible on the person's torso. In cases where flap 322 is attached to the torso portion of the shell, the space occupied by the flap and the stitching attaching the flap to the shell may force the positioning of the slit to be lower on the coat. However, in embodiments where the flap is mounted on the collar, slit 328 may be higher on the shell. For example, with the flap mounted to the collar, slit 328 may be positioned at a point just below the interface between the collar and the torso portions, as shown in FIG. 5.

Figure 4:
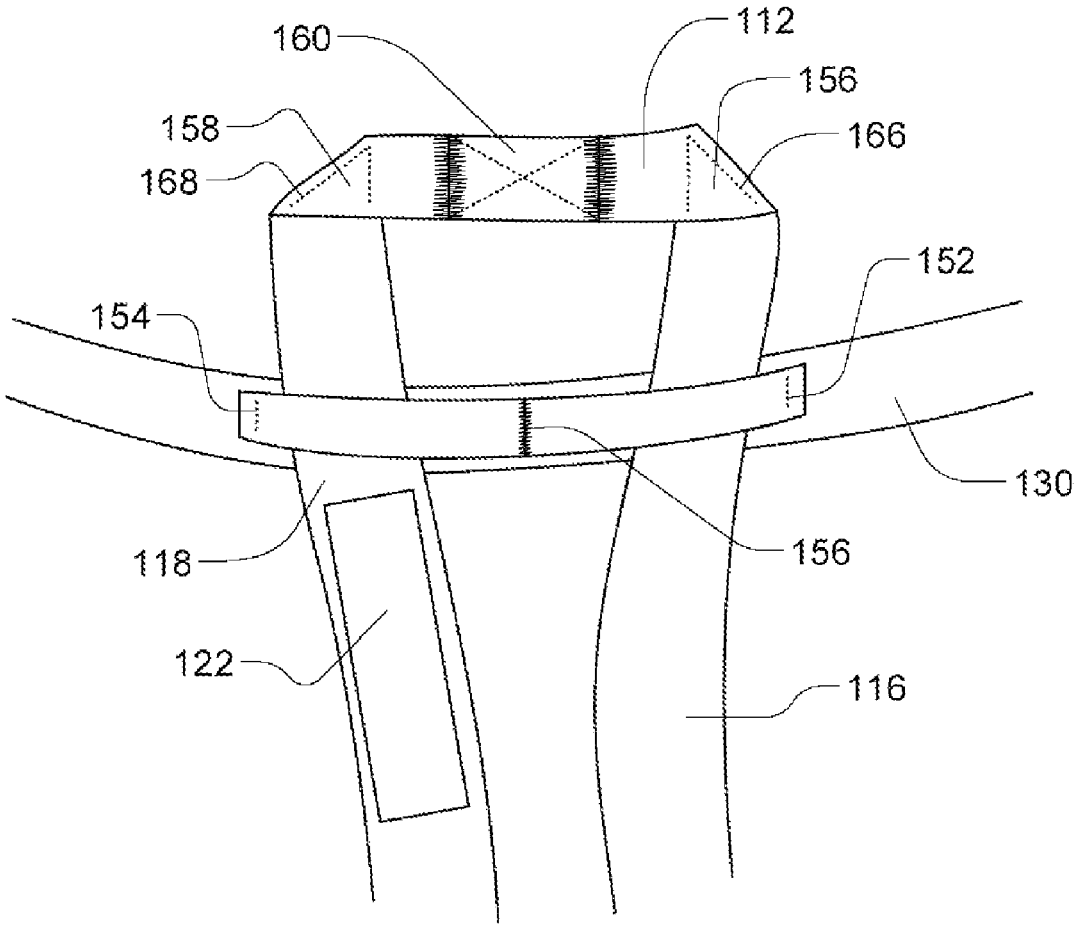
FIG. 4 provides an enlarged view of one section of the device of FIG. 3.

FIGS. 4 and 5 provide close-up views of portions of the drag rescue device that include handle portion 112. Handle 112 may be any portion of the drag rescue device that may be grabbed by a rescuer when the device is deployed. Handle 112 may be accessible by a gloved hand so that it can be used in hazardous conditions. Handle 112 may include portion 160 that comprises the joint where two ends of the webbing are joined to form a continuous loop. The ends may overlap by, for example, one, two or three inches. The joint may be secured by stitching, gluing or using other techniques known to those skilled in the art. Overlapping ends, as well as the stitching, may provide additional rigidity to this portion of the strap and this rigidity can help provide an appropriate handle. In addition, if the overlapping joint is positioned inside the garment instead of being external to it, the stiffened joint area may be uncomfortable against the body. Thus, it may be preferred that the overlapping joint be used as a handle and be positioned external of the coat.

To form a more defined handle portion that may retain its shape, the webbing may be folded down on itself at regions 156 and 158. The strap webbing may include two opposed surfaces, an inner surface and an outer surface. As shown in FIGS. 3, 4 and 5 the webbing may be folded down on itself so that the inner surface of the webbing is folded against the same inner surface at triangular shaped regions 156 and 158. Thus, these triangular regions may include a double thickness of the webbing that may, for example, provide additional rigidity and memory to this portion of the drag rescue device. The fold may be completed so that handle portion 112 is at substantially right angles to leads 116 and 118. Of course the drag rescue device may be flexible, so these angles may be easily conformed to different configurations. Stitching at points 166 and 168 may be used to secure the handle in the folded position. For example, the stitching may run along the outer edge, as shown, at a 45 degree angle to both the handle portion 112 and leads 116 and 118. Additional stitching in this triangular shaped region may help to secure the handle in this configuration and may provide rigidity. In embodiments where overlapping joint 160 is extended to abut triangular regions 156 and 158, the entire handle portion 112, including the turned-down portions, may comprise a double layer of webbing.

Upon installation in a garment, the drag rescue device may be kept in an unobtrusive position. In some embodiments, the user may not even know that he or she is wearing the drag rescue device, particularly when the device is worn between an outer shell and an inner liner. However, it may also be preferred that the device be easily and quickly deployable and that the handle be easily locatable by a rescuer under emergency conditions. The embodiment illustrated in FIG. 5 may provide a configuration that can, for example, aid in locating the handle under emergency conditions.

In the embodiment illustrated in FIG. 5, handle portion 112 of the drag rescue device has been formed as in shown is FIG. 4. Overlapping ends of the webbing have been stitched together and the end portion has been turned down and stitched at regions 156 and 158 to produce a stiffened, substantially horizontal handle. When installed in a garment in an undeployed mode, handle 112 may be retained by tab 340 and may be folded down once more prior to closing flap 322 onto fastener 326. For example, the surface of handle portion 112 that is visible in FIG. 5 is the surface of handle 112 that is not visible in FIG. 4 as it has been turned down. The back side of the handle not seen in FIG. 4 may be revealed by folding down handle 112 to result in the configuration shown in FIG. 5. This folding step may be temporary and the handle may not be fixed in this position. However, the handle may be retained in this position by closing flap 322 before handle 112 can unfold. The fabric of the handle may have some memory and may tend to return to the configuration shown in FIG. 4 when not held in place by flap 322. This memory, or bias, may be increased by, for example, the stitching and/or double layering that comprises the handle.

Upon opening of flap 322, handle 112 may pop up and return, at least partially, to the position shown in FIG. 4. This repositioning of the handle portion may provide for a more easily graspable handle for a rescuer, particularly if the rescuer is wearing gloves. Gloves may make it difficult to grab the handle if it lies flat against the shell. However, if the handle, or a portion of the handle, pops up when flap 332 is opened, a gloved hand may be able to find and grab the handle instantaneously. Once grasped, the drag rescue device may be deployed by withdrawing a portion of the device from slit 328. The device may continue to be withdrawn until the drag rescue device tightens around the wearer. Once any slack has been removed from the device, the webbing may securely tighten under the wearer's arm pits, across his or her back and over his or her shoulders. The wearer may then be quickly dragged to safety with a minimal level of additional injury resulting from the extraction.

In another aspect, a method of reinforcing an opening in a garment may be used to produce a garment having, for example, improved wear and performance characteristics. In one embodiment, two or more pieces of reinforcing material may be affixed to the edges of an opening in a garment to provide a reinforced opening. The two pieces of reinforcing material may be identical or almost identical and may be stitched to opposing edges of the slit.

Openings in garments, particularly those designed for allowing passage of a strap, belt, harness, etc., may subject to forces of wear that are not seen on other portions of the garment. Reinforcing material may be any type of material that can be sewn or otherwise affixed to an opening in the garment to improve the wear characteristics of the opening and is preferably a material that is resistant to fraying. Coated materials, such as those coated with a high solid polymer, may be preferred. Materials used for reinforcement may include polymeric and non-polymeric materials, for example, natural fibers, leather, nylon, polyester, and aromatic polyamides (aramid and para-aramids fibers) such as KEVLAR. Blends of these and other materials may also be used.

Figure 6:
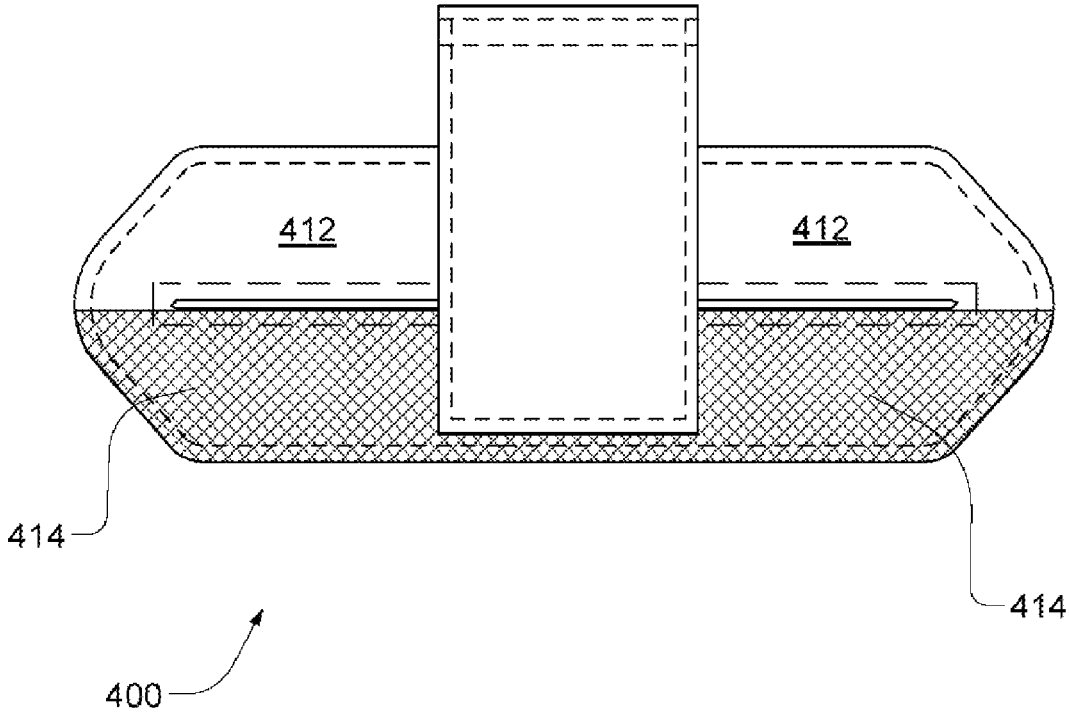
FIG. 6 is an enlarged view of the slit area of the coat shown in FIG. 5.

One embodiment of a reinforced opening is provided in FIGS. 5 and 6. Slit 382 of reinforced opening 400 may be used, for example, to provide passage for a drag rescue device. The reinforcing material may be attached to the garment (an outer shell for example) by, for example, stitching, gluing, welding and/or adhering. Reinforcing material may be on the outer surface of the garment, the inner surface of the garment, or both. A single piece of reinforcing material may cover two surfaces. As shown in FIG. 6, reinforcement halves 412 and 414 may cover opposing sides of a slit and may be mirror images of each other. Reinforcement half 414, as shown in FIG. 6, may be covered by one half of a hook and loop fastener which may be attached to at least a portion of the reinforcing material.

Figure 7:
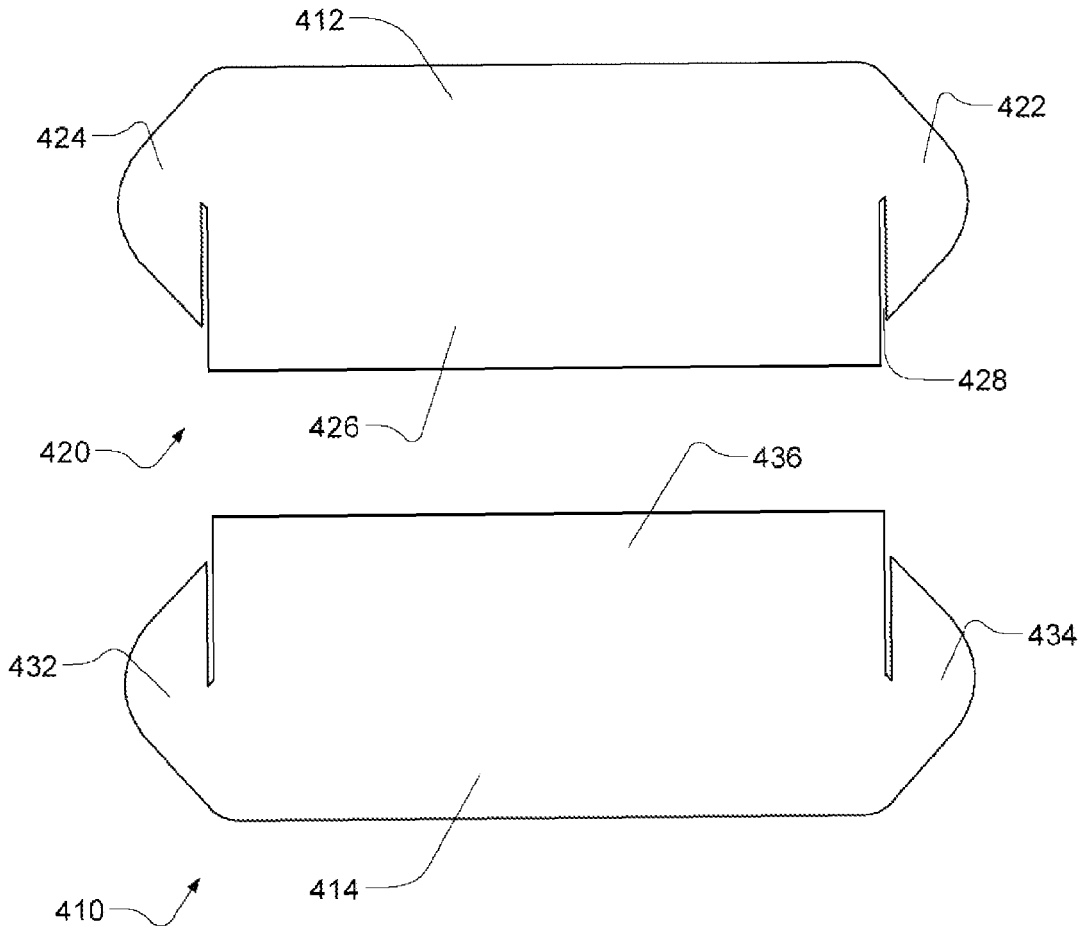
FIG. 7 is a plan view of two sheets of reinforcing material that can be used in one embodiment of the invention.
Figure 8:
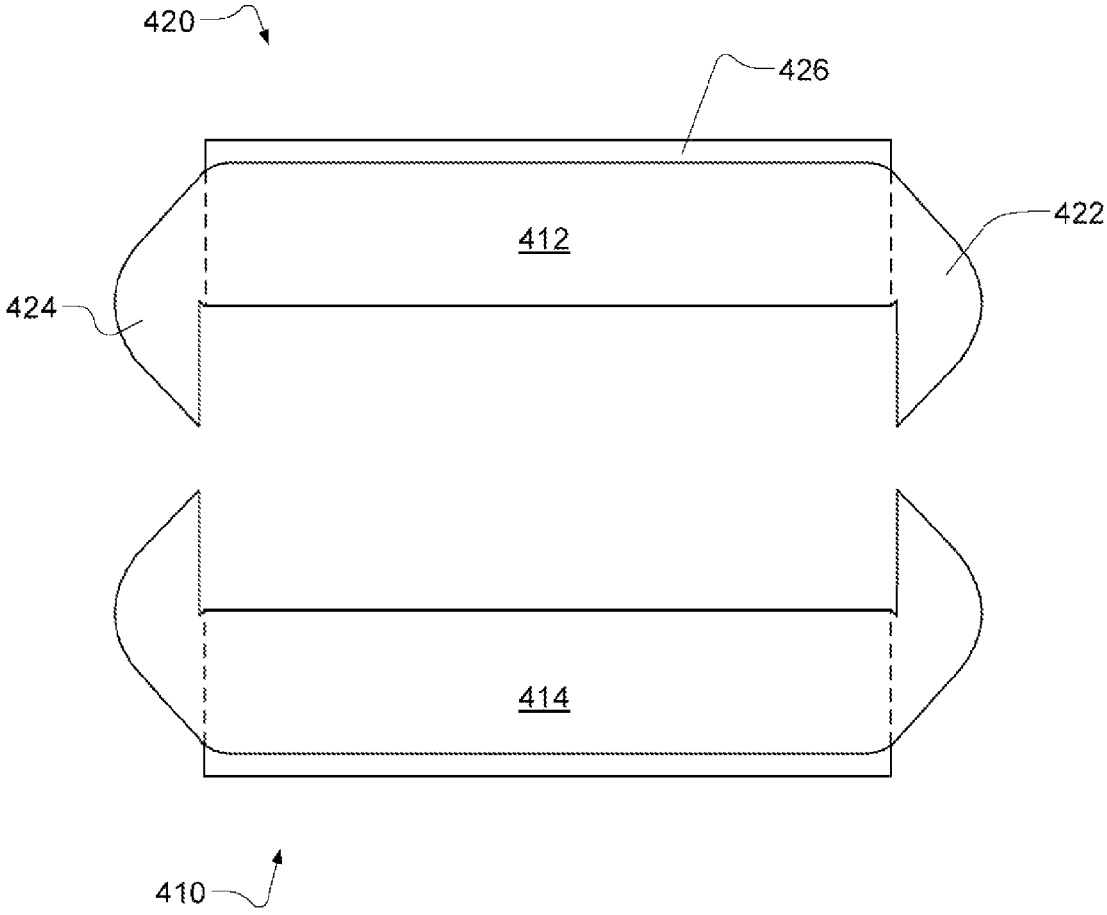
FIG. 8 is a plan view of the sheets of FIG. 7 in an alternate configuration.
Figure 9:
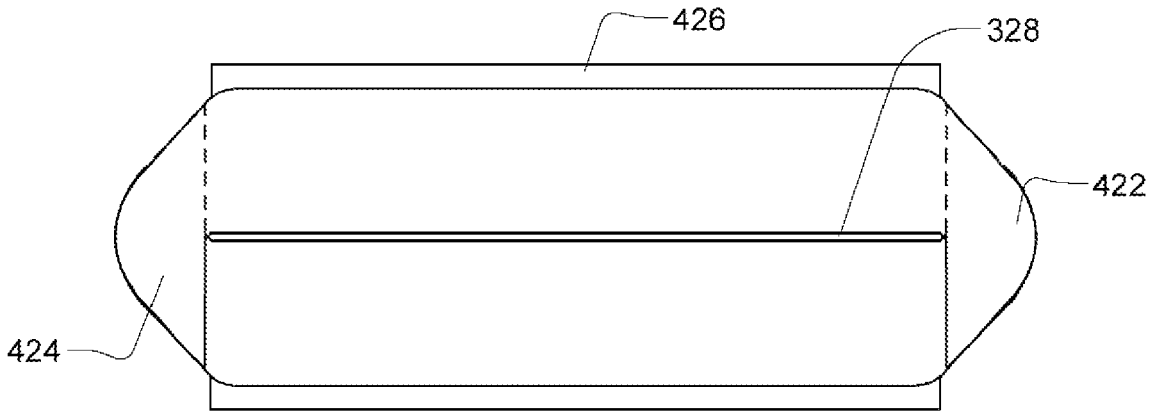
FIG. 9 is a plan view of the sheets of FIG. 7 positioned to form a reinforced slit in a garment.

FIG. 7-11 provide a views of an embodiment where two sheets of reinforcing material may be used together to reinforce a slot such as that shown in FIGS. 5 and 6. Sheets 410 and 420 may, in some cases, be identical in shape and may be formed from the same material. The material may be, for example, strong, abrasion resistant, and flexible. Sheets 410 and 420 may be formed by techniques known to those skilled in the art, such as by cutting or stamping. Each sheet may include a tab 426 and ears 422 and 424. For example, sheet 410 includes ears 432 and 434 as well as tab 436. Slot 428 between ear 422 and tab 426 may allow the ear and the tab to be folded into different planes. For instance, as shown in FIG. 8, tab 426 may be folded 180 degrees underneath while ears 422 and 424 remain in the initial plane of the sheet. Sheet 410, in FIG. 8, is shown as a mirror image of sheet 420 after the same folding procedure.

The reinforcing sheets shown in FIGS. 7 and 8 may be used to reinforce a slit in a garment that has a width approximately equal to the distance between ears 422 and 424 or approximately equal to the length of tab 426. To install the reinforcement into the garment, sheets 410 and 420 may positioned outside the garment, on opposite sides of a pre-cut slit in the garment. The sheets may also be positioned inside, or one inside and one outside of the garment fabric. The sheets may face each other with each providing a mirror image of the other. Tab 412 of sheet 420 and tab 414 of sheet 410 may then be passed through the pre-cut slit and folded up underneath the garment fabric to a position such as that shown in FIG. 8. When the tabs from both sheets have been passed through the slit and been tucked underneath the garment material, the configuration may look like that provided in FIG. 9. Ears 422 and 424 of sheet 420 may overlap and cover the ears of complimentary sheet 410. Thus, in FIG. 9, the ears of sheet 410 lie underneath and in substantial alignment with ears 422 and 424 of sheet 420. Newly reinforced slit 328 now includes abrasion resistant material on top and bottom surfaces. Furthermore, the ends of the slit may be reinforced by ears 422 and 424 as well as ears 432 and 434 of sheet 410, providing a double layer of reinforcement at each end of the slit. The reinforcement may be fixed into position by stitching through a sandwich made of two layers of reinforcing material enclosing a layer of garment material, or a reinforcing material/garment fabric/reinforcing material sandwich. Additionally, the ears on each end of the slit may be stitched to the garment material. Thus, in the area of the ears, the layers may be in the order of reinforcing material/reinforcing material/garment fabric. Stitching may be applied around the perimeter of the reinforcement. This may help, for example, to provide a finished look and to prevent edges of the reinforcing material from being snagged on objects or people.

In another embodiment, the same sheets of reinforcing material may be used but one of the tabs may be passed through the slit from the inside of the garment fabric and the other passed through from the outside of the garment. In this embodiment, the ears of one sheet may be positioned flat against (adjacent) the inside surface and the ears of the other sheet may be flat against (adjacent) the outer surface. Stitching of the reinforcement material may result in a sandwich of reinforcement material/garment fabric/reinforcement material in the ear regions as well as in the tab regions.

If another component, such as a part of a hook and loop fastener (FIG. 6), is to be attached to the reinforced area, it may be preferred that the reinforcing material be arranged so that the ends of the ears on the outer garment surface are covered by the loop (or hook) fastener. This may provide, for example, a cleaner, more seamless appearance. This fastener may be used to secure a tab for dividing the slit into two passageways and/or for a flap to cover and protect the slit from intrusion by water and other materials.

While several embodiments of the present invention have been described and illustrated herein, those of ordinary skill in the art will readily envision a variety of other means and/or structures for performing the functions and/or obtaining the results and/or one or more of the advantages described herein, and each of such variations and/or modifications is deemed to be within the scope of the present invention. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings of the present invention is/are used. Those skilled in the art will recognize, or be able to ascertain using no more than routine experimentation, many equivalents to the specific embodiments of the invention described herein. It is, therefore, to be understood that the foregoing embodiments are presented by way of example only and that, within the scope of the appended claims and equivalents thereto, the invention may be practiced otherwise than as specifically described and claimed. The present invention is directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the scope of the present invention.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Other elements may optionally be present other than the elements specifically identified by the "and/or" clause, whether related or unrelated to those elements specifically identified, unless clearly indicated to the contrary.

All references, patents and patent applications and publications that are cited or referred to in this application are incorporated in their entirety herein by reference.

What is claimed is:

1. A drag rescue device for use with a coat, the drag rescue device comprising:

a loop of ribbon-shaped material including a left portion and a right portion, the portions joined to each other at a drag end of the loop, the drag end configured and arranged to pass through an opening in the coat; and a guide attached to a portion of the loop that is distal to the drag end, the guide comprising a right guide channel and a left guide channel, the left portion of the loop passing slidably through the left guide channel and the right portion of the loop passing slidably through the right guide channel, the left and right portions being non-removable from the guide channels;

wherein the guide comprises a strip tacked to a central portion of the loop at left, central and right locations to form the two guide channels between the central portion of the loop and the strip, each of the guide channels separated from the other guide channel by the central tack location.

2. The drag rescue device of claim 1 wherein two ends of the ribbon-shaped material are permanently joined to each other at the drag end to form the loop.

3. The drag rescue device of claim 1 wherein each guide channel comprises a strip that is independent from the other guide channel strip.

4. The drag rescue device of claim 1, the loop comprising:

a first surface and a second surface opposed to the first surface;

a handle portion formed in the drag end of the loop; and a left lead in the loop joining the handle to the left portion of the loop and a right lead in the loop joining the handle to the right portion of the loop, the left and right leads substantially parallel to each other and at substantially 90 degrees to the handle, the first surface of the handle portion of the loop being permanently folded against the first surface of the right lead and the first surface of the left lead.

5. A drag rescue system comprising:

the drag rescue device of claim 1; and a coat comprising a shell having an inside and an outside, the shell including a back portion that defines a slit for passage of the drag rescue device, wherein shoulder portions of the loop are inside the shell and a handle portion of the loop is positioned outside the shell.

6. The system of claim 5 wherein the coat comprises a collar and a flap mounted on the collar, the flap constructed and arranged to cover the slit in the back when the flap is in a closed position.

7. The system of claim 6 further comprising a dividing tab closeable across a portion of the slit, the dividing tab rendering the slit into two distinct conduits, each conduit carrying a portion of the loop leading to the handle, whereby the dividing tab, when closed, prevents the handle portion from sliding into the inside of the shell.

8. The system of claim 6 wherein the flap includes a fastener for securing the flap over the slot.

* * * * *